United States Patent [19]

Keller

[11] Patent Number: 4,566,286

[45] Date of Patent: Jan. 28, 1986

[54] AUTOMATIC ICE HOPPER

[76] Inventor: Paul Keller, 1004 94th Ave., NW., Coon Rapids, Minn. 55433

[21] Appl. No.: 604,582

[22] Filed: Apr. 27, 1984

[51] Int. Cl.[4] ..... F25C 5/18

[52] U.S. Cl. ..... 62/135; 62/344; 141/198; 141/DIG. 1; 200/61.2; 340/612

[58] Field of Search ..... 62/344, 137, 135; 141/198, DIG. 1, 326; 340/612, 615, 617, 686; 200/61.04, 61.07, 61.2, 61.21; 335/205

[56] References Cited

U.S. PATENT DOCUMENTS

| | | | |
|---|---|---|---|
| 2,194,604 | 3/1940 | Malsbary | 200/61.2 X |
| 3,204,232 | 8/1965 | Meyer | 200/61.2 X |
| 3,246,313 | 4/1966 | Weaklend | 340/617 |
| 3,287,720 | 11/1966 | Chambers, III et al. | 340/615 |
| 3,712,076 | 1/1973 | Fox | 62/137 |
| 3,715,539 | 2/1973 | Silberg et al. | 200/61.2 X |
| 3,852,692 | 12/1974 | Moorman | 335/205 |
| 4,426,851 | 1/1984 | Neumann | 340/617 X |

*Primary Examiner*—William E. Tapolcai

*Attorney, Agent, or Firm*—David Pressman

[57] ABSTRACT

An ice-making machine includes a hopper (10) which is provided with means for automatically switching the machine off when the ice collected in the hopper rises to a predetermined level. The hopper comprises a cup-shaped bowl (14) covered with a flanged collar (24) slidable within the bowl. The collar (24) in turn is covered with a lid (32) which is press fitted onto its upper cylindrical part (28). Magnetic switches (38 and 40) are attached to collar (24) and magnetically sensitive contacts of the switches are mounted in bowl (14). The switches are connected in series in the circuit of the drive motor of the ice-making machine and are normally closed. When ice fills the bowl to a predetermined level, the lid and the collar, which is rigidly connected to the lid, are lifted, thereby breaking the contacts and turning the ice-making machine off. When, after consumption of ice, its level in the bowl is lowered, the lid and the collar descend, closing the contacts and reenergizing the ice-making machine.

20 Claims, 3 Drawing Figures

FIG 2

AUTOMATIC ICE HOPPER

BACKGROUND

Field of the Invention

The present invention relates to ice making, particularly to an automatic hopper which receives ice produced by an ice-making machine and switches the machine off when the hopper is filled.

BACKGROUND

Description of Prior Art

Ice makers are now extensively used in drink-vending machines to provide pieces of ice in the beverage cup to cool the beverage dispensed by the machine. These ice makers usually comprise an ice-making mechanism surrounded by a hopper which collects and holds the ice dispensed by the mechanism. The hopper is provided with means for automatically switching off the mechanism when the ice in the hopper exceeds a predetermined level.

It is been known to incorporate the switch-off means in a lid or cover of the hopper. An electrical switch is attached to the central upper part of the hopper's cover and is electrically connected in a circuit by external wires. The switch is controlled by a mechanical sensor or feeler (wire or lever arm) located inside the hopper. When ice fills the hopper to a predetermined level, it raises the sensor, which in turn switches off the ice-making mechanism.

This mechanism has a number of disadvantages. First, the switch occupies a useful space of about 11.5 cm×5 cm×5 cm (4½"×2"×2") and took about 25% or more of the volume of the hopper. (The total height of the hopper itself usually is only about 15 cm (6")). Second, the switch's external leads restricted freedom of motion of the machine as a whole. Third, since the mechanical sensor is made of metal, it must to be protected from contact with ice by rubber or other heat-insulating non-corrosive material. Also, the mechanisms presently used are relatively complex, unreliable, heavy, and expensive.

OBJECTS AND ADVANTAGES OF THE PRESENT INVENTION

Accordingly several objects of the present invention are: to provide an ice-making machine with a simple and reliable hopper mechanism which automatically switches off the ice-producing mechanism when ice fills the hopper to a predetermined level; to improve freedom of movement of the ice making machine by eliminating external wires therefrom; to increase the useful space inside an ice-storage hopper by eliminating any parts protruding from outer and inner surfaces of the hopper's lid; and to simplify manufacture and to reduce the weight of the hopper and thereby reduce the cost of the machine as a whole. Further objects and advantages of the present invention will become apparent from a consideration of the ensuing description and drawings.

DETAILED DESCRIPTION OF THE INVENTION

Figure 1:
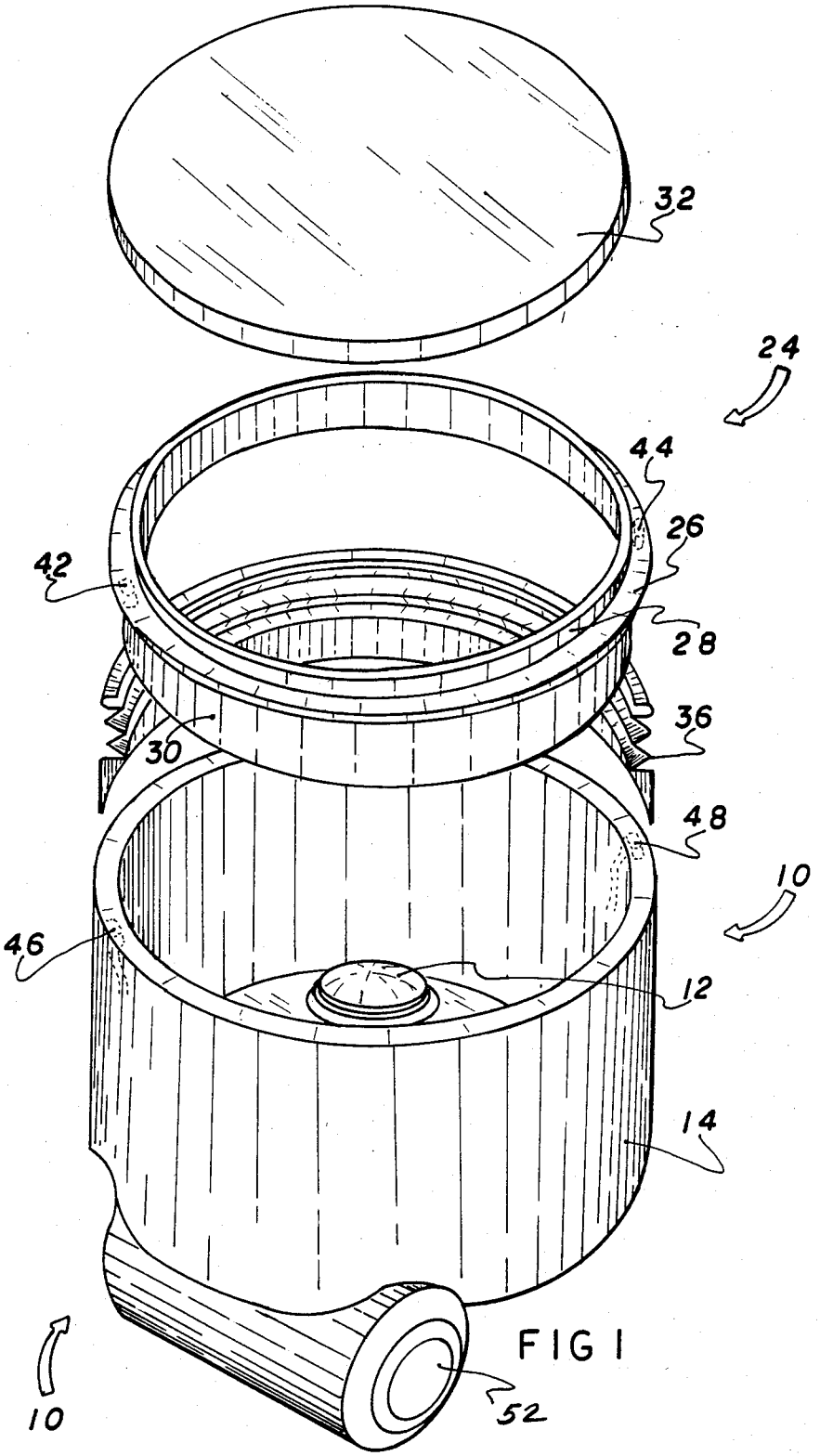
FIG. 1 is an exploded perspective view of an automatic hopper of the present invention.

The automatic hopper of the invention is generally designated in FIG. 1 by reference numeral 10. Hopper 10 is mounted around a conventional ice-making machine 12, only the dispensing head of which is shown. The ice-making machine preferably is of the type shown in my copending application, Ser. No. 06/509,322, filed June 30, 1983 entitled "Ice Maker for Producing Variably-Sized Sheet Ice".

Figures 2, 3:
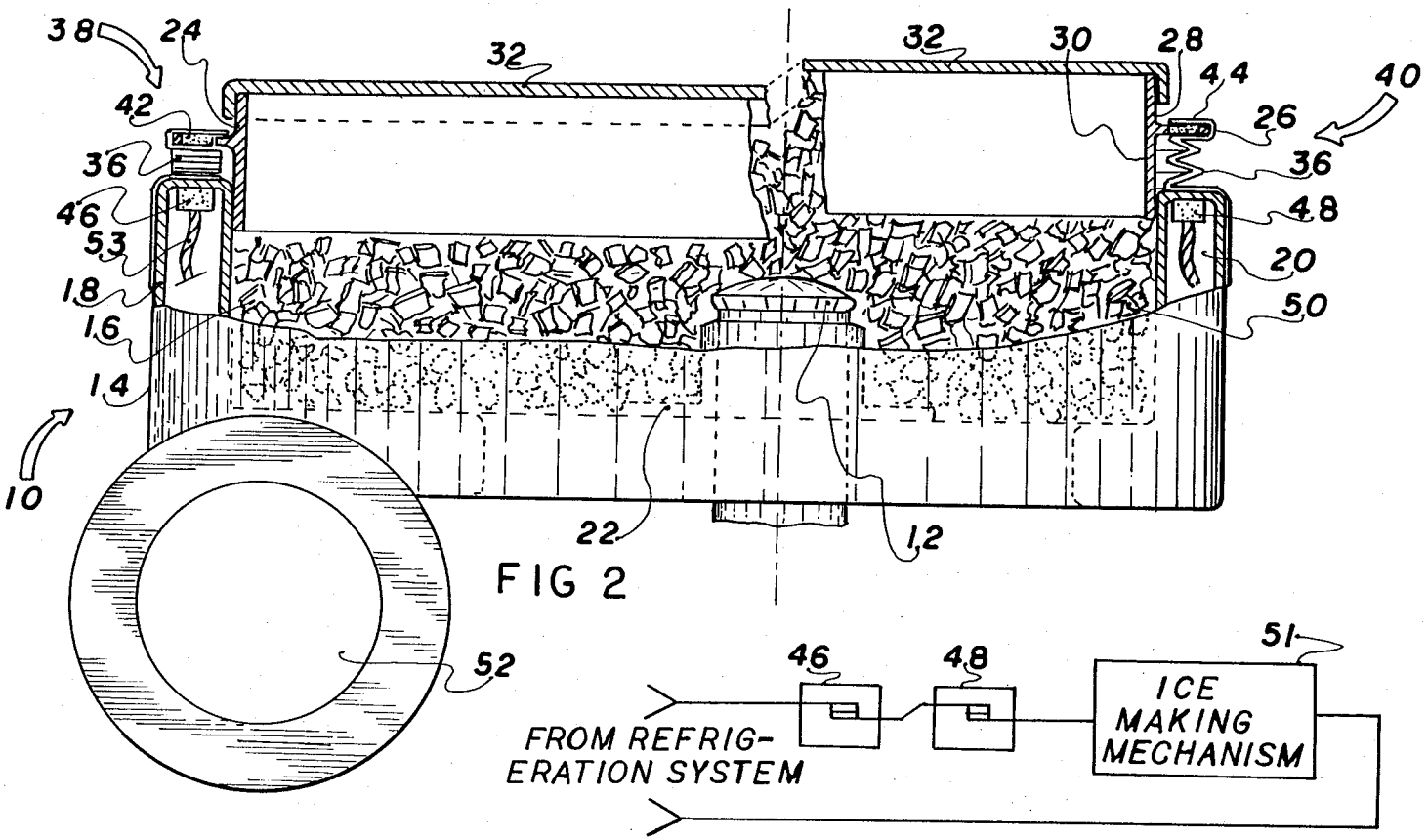
FIG. 2 is a cross-sectional view of the hopper of FIG. 1 wherein parts on the left of the axis illustrate the hopper in a normal working position and parts to the right show the hopper in the fully-loaded switched off position.
FIG. 3 is a circuit diagram of an automatic hopper of the present invention.

As shown in FIGS. 1 and 2, hopper 10 comprises a cylindrical, cup-shaped bowl 14 which has its open end facing upward. The side wall of hopper 10 is a double-walled structure formed by an inner wall 16 and an outer wall 18. Walls 16 and 18 sandwich an air- or insulation-filled gap 20 for heat insulation purposes and for the location of wiring, the purpose of which will be explained hereinafter. Bowl 14 has an inside diameter of about 29 cm (11") and depth of about 16 cm (6"); the other parts shown can be sized approximately to the scale indicated. An opening is provided in the center of the bottom of bowl 14 for ice-making machine 12. A seal 22 prevents leakage of liquid accumulated on the bottom of bowl 14 due to melting of ice.

A cylindrical flanged collar 24 is provided at the top of hopper 10. Collar 24 has a flange 26 separating the collar into an upper cylindrical partion 28 and lower cylindrical portion 30, the latter being dimensioned to fit in a loose or sliding manner into the upper part of bowl 14.

Upper portion 28 of collar 24 is covered with a circular lid 32 which has a downward collar which is fit or attached to portion 28 by any suitable means (not shown), e.g., pegs and catches, threading, fasteners (bolts or pins), etc.

Bowl 24, collar 24, and lid 32 preferably are made of any plastic material, such as Delrin resin, which possesses a low thermal conductivity and is hygenically acceptable.

A bellows 36 connects the lower surface of flange 26 and the upper surface of bowl 14 so that it embraces lower cylindrical portion 30 of collar 24. Bellows 36 thus seals the outer surface of cylindrical portion 30 when collar 24 slides vertically within bowl 14. The upper and lower ends of bellows 36 are attached by a suitable means (not shown), such as adhesive, fasteners, etc., to the lower surface of flange 26 and upper surface of bowl 14 respectively. Bellows 36 is made of flexible plastic, rubber, or resin impregnated fabric.

The automatic control function of the hopper is fulfilled by a pair of magnetic proximity switches 38 and 40, e.g., of the type used in burglar alarms. Switches 38 and 40 are identical. Left switch 38 consists of an upper actuating magnet 42 and a lower magnetically-actuable reed switch 46, while right switch 40 consists of magnet 44 and reed switch 48. Magnets 42 and 44 are mounted at opposite positions within suitable recesses in the flange of collar 26, while reed switches 46 and 48 are mounted within space 20 under the upper rim of bowl 14.

Each of reed switches 46 and 48 has a pair of normally-open contacts (the contacts are shown closed in FIG. 3); these are connected in series between an ice-making mechanism 51 and an electrical supply source which is energized in a conventional fashion when the refrigerator system is operative. Leads 53 from switch 46 (and similar leads from switch 48) are dressed within space 20, between walls 18 and 16 of bowl 14.

Hopper 10 has a horizontal outlet 52 in the lower part of bowl 14, this outlet communicates with the interior of bowl 14 and includes an ice-unloading auger (not shown) which extends across the bottom of bowl 14. The interior of bowl 14 is normally filled with ice chips or flakes 50.

OPERATION OF THE AUTOMATIC HOPPER

During the operation of the ice-making machine, lid 32 and collar 26 rest upon bowl 14, as indicated at the left side of FIG. 2, so that magnets 42 and 44 close reed switches 46 and 48, respectively, as shown in FIG. 3. This ice-making mechanism 51 is energized and pieces of ice 50 are discharged from dispensing head 12 into the interior of bowl 14. These are withdrawn upon customers' demand by the unloading auger in outlet 52.

If the rate of supply of ice, however, exceeds its rate of consumption, the level of ice in bowl 14 will rise until it reaches lid 32, pushing it up, as indicated at the right side of FIG. 2. As a result, since lid 32 is fit onto collar 24, the collar will also pushed up from bowl 14. Flange 26 will thus rise, separating magnet 42 or 44, or both, from its respective reed switch 46 or 48, respectively. As a result, either of switches 46 or 48, or both, will open, thereby switching off ice-making mechanism 51.

One side of lid 32 will be raised before the other if ice builds up more quickly on one side of bowl 14 than on the other. Since switches 46 and 48 are connected in series, the ice-making mechanism will be switched off if either or both sides of lid 32 are raised.

When the level of ice in the bowl is reduced, lid 32 and collar 24 will descend under the influence of gravity. Magnets 42 and 44 will then come close enough to close switches 46 and 48, whereby the production of ice will resume.

Since leads 53 from the magnetically sensitive switch are dressed within space 20, they do not restrict movement of the ice maker. By virtue of the use of the bellows, the press-fit lid, and the flanged collar with its built-in magnets, and the ice can be kept sanitary and thermally insulated, while providing a highly-reliable, economical, space-efficient, and simple ice-level control mechanism.

It is obvious that many other modifications of the automatic hopper are possible. For example, the bowl may have any shape other than cylidrical, more than two switches can be used, other types of switches can be utilized, the lid can be made integrally with the collar and the bellows separable from the collar or bowl, a side or top ice dispenser can be used, etc. Therefore the scope of the invention should be determined, not by the example given, but by appended claims and their legal equivalents.

What I claim:

1. An automatic hopper for an ice-making machine, comprising:

a container for receiving and storing pieces of ice from an ice-making mechanism, said container having substantially vertical walls and an open top bordered by said walls, said open top being as wide as said container, means for conveying said pieces of ice into said container from said ice-making mechanism, cover means for covering said container, said cover means comprising a rigid member which is as wide as said container and which covers the entire open top of said container, said cover means being loosely fitted onto the top of said container and arranged such that when ice which is conveyed into said container builds up in any part of said container to a level above the level of said cover means, said ice will push said cover means up and away from said container, control means for controlling the operation of said ice-making mechanism, said control means being positioned such that when said cover means moves up and away from said container in response to the buildup of ice in any part of said container, said control means will switch off said ice-making mechanism.

2. The automatic hopper of claim 1 wherein said cover means has a flange which engages the upper surface of said walls of said container, said control means being attached to corresponding mating surfaces of said flange and the upper portions of the walls of said container.

3. The automatic hopper of claim 1 wherein said control means comprises at least one switch, the contacts of said switch being connected in series with said ice-making mechanism and its power supply.

4. The automatic hopper of claim 3 wherein said control means comprises two switches which have diametrically-opposite positions.

5. The automatic hopper of claim 3 wherein said control means comprises a magnetic proximity switch.

6. The automatic hopper of claim 3 wherein said control means comprises a pair of magnetic proximity switches, one at each side of said container.

7. The automatic hopper of claim 6 wherein said switches each comprise a magnetic reed switch and a magnet, each magnet being mounted in said cover means and each reed switch being mounted in said container.

8. The automatic hopper of claim 1 wherein said container comprises a cup-shaped bowl made of a material with low thermal conductivity.

9. The automatic hopper of claim 1 wherein said container is double-walled and has a space between external and internal walls thereof, the wiring for said control means being located in said space.

10. The automatic hopper of claim 1 wherein said container is made of a material which is hygienically compatible with ice for cooling potable beverages.

11. The automatic hopper of claim 1 wherein said container includes an ice-discharging means.

12. The automatic hopper of claim 11 wherein said ice-discharging means comprises an outlet located in a lower part of said bowl, said outlet connecting the interior of said bowl with the exterior thereof.

13. An automatic hopper for an ice-making machine, comprising:

a container for receiving and storing ice from an ice-making mechanism cover means for said container, said cover means being arranged so that at least a part thereof will move up and away from said container in response to the buildup of ice above the top of said container, control means for controlling the operation of said ice-making mechanism, said control means being positioned such that when said cover means, or any part thereof, moves away from said container, said control means will switch off said ice-making mechanism, and expandable sealing means which is attached, one end thereof to said cover means and the other end to said container, thereby to provide a hygienic seal between said cover means and said container when said cover moves away from said container.

14. The automatic hopper of claim 13 wherein said expandable sealing means comprises a bellows.

15. The automatic hopper of claim 13 wherein said container includes an ice-discharging means.

16. The automatic hopper of claim 15 wherein said ice-discharging means comprises an outlet located in a lower part of said container, said outlet connecting the interior of said container with the exterior thereof.

17. An automatic hopper for an ice-making machine, comprising:

a container for receiving and storing ice from an ice-making mechanism, cover means for said container, said cover means being arranged so that at least a part thereof will move up and away from said container in response to the buildup of ice above the top of said container, and control means for controlling the operation of said ice-making mechanism, said control means being positioned such that when said cover means, or any part thereof, moves away from said container, said control means will switch off said ice-making mechanism, said cover means comprising a cylindrical collar with an outer flange which divides said collar into upper and lower cylindrical parts, and a lid which is rigidly connected to said upper cylindrical part of said collar, said lower cylindrical part of said collar having a sliding fit within said container.

18. The hopper of claim 17 wherein said lid is press-fitted onto said collar.

19. The automatic hopper of claim 17 wherein said control means comprises a magnetic proximity switch.

20. The automatic hopper of claim 17 wherein said control means comprises a pair of magnetic proximity switches, one at each side of said container.

* * * * *